United States Patent [19]

Campbell

[11] Patent Number: 4,540,108

[45] Date of Patent: Sep. 10, 1985

[54] NEEDLEPOINTING TOOL

[76] Inventor: Jeptha E. Campbell, 1618 Dell Ter., Cincinnati, Ohio 45230

[21] Appl. No.: 611,504

[22] Filed: May 17, 1984

[51] Int. Cl.[3] ..... D05C 15/06

[52] U.S. Cl. ..... 223/102; 112/80

[58] Field of Search ..... 223/102, 103, 104; 112/80, 266.1, 266.2

[56] References Cited

U.S. PATENT DOCUMENTS

| | | | |
|---|---|---|---|
| 370,309 | 9/1887 | Borton | 112/80 |
| 951,459 | 3/1910 | Shupe | 223/102 X |
| 2,541,543 | 2/1951 | Perhacs | 223/102 |
| 2,620,104 | 12/1952 | Graham | 223/102 |
| 3,240,176 | 3/1966 | Morrison | 112/80 |

*Primary Examiner*—Werner H. Schroeder
*Assistant Examiner*—J. L. Kravitz
*Attorney, Agent, or Firm*—Antonelli, Terry & Wands

[57] ABSTRACT

The invention is a tool for use in grasping yarn during the making of needlepoint with a mesh having openings through which yarn is stitched including a handle having first and second ends located on a longitudinal axis; a member extending from the first end of the handle along the longitudinal axis; and a yarn grasping head joined to an end of the member at a position remote from the first end of the handle, the yarn grasping head having first and second bifurcations extending in the direction of the longitudinal axis, the bifurcations respectively having first and second ends and being joined together at one end to form a vertex for grasping yarn in the vertex, the bifurcations being spaced apart from each other by a substantially constant distance along the longitudinal axis except in proximity to the vertex to form an opening through which yarn can pass for grasping within the vertex, each bifurcation being deflectable to permit deflection toward the other bifurcation when engaging an opening in the mesh to tighten the grasp of yarn disposed between the bifurcations and to spring back to their spaced apart position when not engaging an opening in the mesh, the first and second ends of the bifurcations which define the opening having a taper extending from an outside surface of the bifurcation to the opening to provide a pointed end so that engagement of the tapered end with an opening in the mesh causes the bifurcations to more tightly engage yarn disposed therebetween.

16 Claims, 7 Drawing Figures

NEEDLEPOINTING TOOL

BACKGROUND OF THE INVENTON

1. Field of the Invention

The invention relates to tools for use in making or repairing needlepoint. More specifically, the invention relates to tools designed for use in circumstances where a conventional needle cannot be used to grip yarn during the making or repairing of needlepoint.

2. Description of the Prior Art

Bifurcated tools for use with the manufacturing or repair of textiles are known. See U.S. Pat. Nos. 3,240,176, 2,605,943, 2,541,543, 657,608, and 390,599. None of the tools described in the aforementioned patents produces a secure gripping of yarn disposed between yarn gripping bifurcations by the action of the bifurcations being deflected inward into surface contact with the yarn when the outside surface of the bifurcations engages the sides of the whole in a mesh opening through which the yarn is being forced. None of the tools described in the aforementioned patents securely grips yarn when it is being forced between the opening of a needlepoint mesh when the end of the yarn is too short to push he needle back through the matrix to complete a stitch; when yarn that has been pulled from the rear of the mesh through the wrong opening of the mesh is being removed therefrom; or when a snag has developed in a finished needlepoint which requires repair from the finished side.

SUMMARY OF THE INVENTION

The present invention is a tool designed for the making and repairing of needlepoint. More specifically, the present invention is a tool useful for needlepointing in circumstances where it is impossible to grip yarn securely with a standard needle.

A tool in accordance with the present invention includes a handle having first and second ends located at opposite ends of a longitudinal axis of the handle; a member extending from the first end of the handle along the longitudinal axis; and a yarn grasping head joined to an end of the member at a position remote from the end of the handle having first and second bifurcations extending in the direction of the longitudinal axis with the bifurcations respectively having first and second ends and being joined together at the first ends to form a vertex for grasping yarn in the vertex. The bifurcations are spaced apart from each other by a substantially constant distance along the longitudinal axis except in proximity to the vertex to form an opening through which yarn passes for grasping within the vertex; inwardly deflectible toward the other bifurcation when engaging an opening in a mesh to tighten the grip of yarn disposed between the bifurcations when the yarn is being forced through the mesh; and springing back to their spaced apart position when not engaging an opening in the mesh. The first and second ends of the bifurcations which define the opening each have a taper extending from an outside surface of the bifurcation to the opening to provide a pointed end so that engagement of the tapered end with the opening in the mesh causes the bifurcations to more tightly engage yarn disposed therebetween. Preferably, the second end of each of the bifurcations is a conic section and has a length of at least five times greater than the spacing between the bifurcations. The inside surface of each of the bifurcations is substantially flat to maximize the surface area of the bifurcation which engages the yarn.

The invention has several advantages over the prior art. A tool in accordance with the invention may be used to grip short ends of yarn which cannot be threaded through the eye of a needle and pulled from the backside to the front side of the mesh to complete a stitch. Moreover, the present invention may be used to remove a stitch which has been threaded through the wrong mesh by forcing a loop of the yarn from the front side to the back side to facilitate removal of the stitch from the wrong mesh. Finally, the present invention may be used to repair snags in a finished piece of needlepoint by permitting the forcing of the snag from the front side through the back of the mesh.

DESCRIPTION OF THE PREFERRED EMBODIMENT

Figure 1:
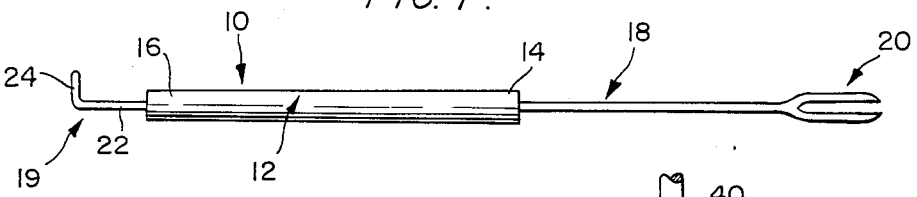
FIG. 1 is a plan view of the present invention.

FIG. 1 illustrates a needlepoint tool 10 in accordance with the present invention. The tool has an elongated handle 12 which has a first end 14 and a second end 16 which respectively engage a first member 18 and a second member 19. The first member 18 has a straight section which extends from the point of attachment with end 14 of the handle 12 to a yarn gripping head 20. Preferably, the member 18 is located on the longitudinal axis of the handle 12. The second member 19 has a first section 22 which is joined to end 16 of handle 12 and a second section 24 which forms a right angle bend with section 22. The section 19 is useful for generally gripping stitches from a needlepoint mesh to permit their pulling out therefrom.

Figure 4:
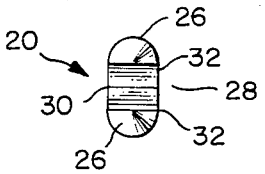
FIG. 4 is an end view of the yarn engaging end of the present invention.
Figure 7:
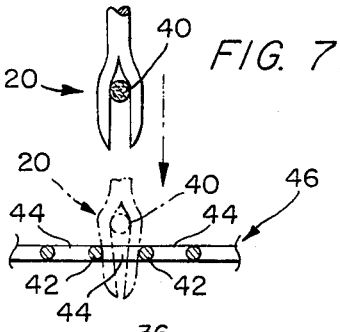
FIG. 7 is a view illustrating the function of the deflectible bifurcations of the invention in securely gripping yarn when the outside surfaces of the bifurcations are engaging the sides of an opening in a needlepoint mesh.
Figure 2:
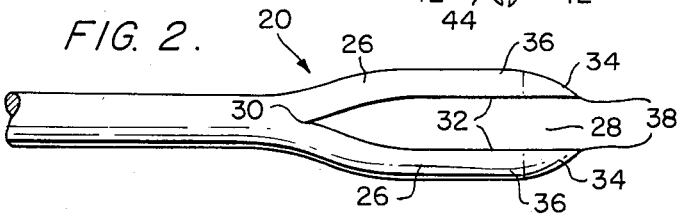
FIG. 2 is an enlargement of the yarn engaging end of the present invention which illustrates the bifurcations therein.
Figure 3:
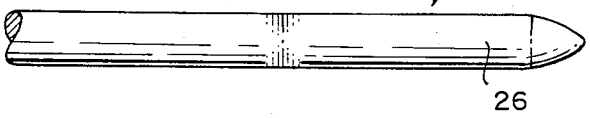
FIG. 3 is a top view of the yarn engaging end of FIG. 2.
Figure 5:
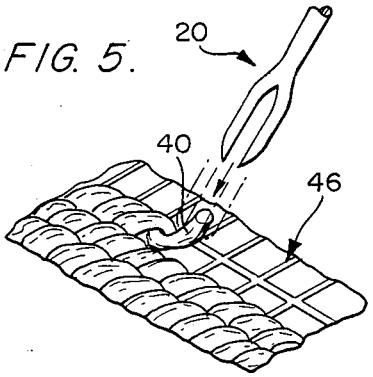
FIG. 5 is a view illustrating the use of the invention for grasping a length of yarn too short for grasping with a conventional needle.
Figure 6:
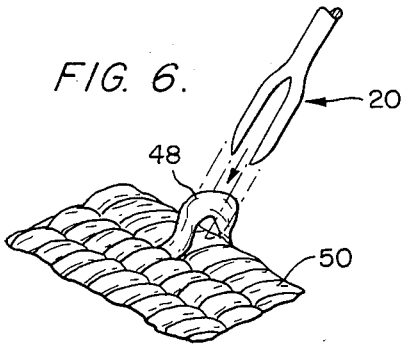
FIG. 6 is a view illustrating the use of the invention for repairing a snag in a finished piece of needlepoint by forcing the snag back through to the unfinished side.

FIGS. 2 thru 4 respectively illustrate views of the yarn engaging head 20. The yarn engaging head 20 has first and second bifurcations 26 which form an opening 28 through which yarn may pass. The bifurcations meet in a vertex 30 which engages yarn during the forcing of the yarn through a mesh as illustrated in FIGS. 5–7. The inside surfaces 32 of the bifurcations, as illustrated in end view FIG. 4, are substantially flat to provide maximum surface engagement with the yarn to minimize slippage. The ends 34 of the bifurcations 26 which define the opening 28 are tapered from the outside surface 36 of the bifurcations to a point 38. Preferably, the taper is in the form of a conic section.

An important aspect of the present invention is that the bifurcations 26 are deflectible toward each other to close the spacing therebetween to more securely engage a piece of yarn 40 when the tapered outside surface 36 engages the sides 42 of an opening 44 in a piece of mesh 46 as illustrated in FIG. 7. As soon as the outside surface 36 of the bifurcations clears from engagement of the sides 42 of the opening 44 of mesh 46, the bifurcations 26 spring back to their spacing as illustrated in FIG. 2. While the degree of spring in the bifurcations may be varied, it is necessary that the bifurcations be sufficiently deflectible that the application of a small downward (along the longitudinal axis) force, as illustrated in FIG. 7, causes the bifurcations to "cam" inward. It has been found that a standard needle may be used with the head ground off to form the opening 28 between the tapered ends 34 which end in point 38 to produce bifurcations with an acceptible degree of deflectability. The invention may be practiced with bifurcations 26 of varying degrees of springiness as long as the bifurcations are not so resilient to make it impossible to deflect the bifurcations toward each other when the outside surface 36 engages the sides 42 of the opening 44 of the mesh 46.

In accordance with the preferred embodiment of the invention, it has been found that the length of the bifurcations as measured between point 38 and vertex 30 should be at least five times greater than the separation between points 38. This degree of elongation of the bifurcations 26 contributes to their springiness and permits the yarn to be sufficiently deeply seated in the vertex 30 away from the opening 28 to make it difficult to inadvertently lose the yarn from engagement in the vertex by hand movements of the user of the invention.

FIG. 5 illustrates the usage of the present invention in grasping a short piece of yarn 40 to force it from the front side of the mesh 46 to the back side. The advantage of the present invention is that a short length of yarn does not limit the ability of the user to continue making of a needlepoint which is not the situation where a short end of yarn is engaged in the eye of a conventional needlepoint needle.

FIG. 6 illustrates the use of the invention to grasp a snag 48 in a finished piece of needlepoint 50 to facilitate the pushing of the snag through to the back side of the needlepoint where it will not show. The repairing of snags is not possible with conventional needles for the reason that there is no free yarn end which can be threaded through the eye of the needle to engage the yarn. Moreover, the sharp point of the needle does not have sufficient frictional engaging properties to permit the forcing of the snag 48 down through to the back side of the finished piece of needlepoint 50. It is difficult or impossible to force snags through to the backside of a finished piece of needlepoint with a sharp pointed object such as a needle.

While the invention has been described in terms of its preferred embodiment, it should be understood that numerous modifications may be made thereto without departing from the spirit and scope of the invention as defined in the appended claims.

I claim as my invention:

1. A tool for use in grasping yarn during the making of needlepoint with a mesh having openings through which yarn is stitched comprising:

(a) a handle having first and second ends disposed on a longitudinal axis;

(b) a member extending from the first end of the handle along the longitudinal axis; and (c) a yarn grasping means joined to an end of the member at a position remote from the first end of the handle, said yarn grasping means having first and second bifurcations extending in the direction of the longitudinal axis, the bifurcations respectively having first and second ends and being joined together at one end to form a vertex for grasping yarn in the vertex, the bifurcations being spaced apart from each other by a substantially constant distance along the longitudinal axis except in proximity to the vertex to form an opening through which yarn can pass for grasping within the vertex, each bifurcation being deflectable to permit deflection toward the other bifurcation when engaging an opening in the mesh to tighten the grasp of yarn disposed between the bifurcations and to spring back to their spaced apart position when not engaging an opening in the mesh, the first and second ends of the bifurcations which define said opening having a taper extending from an outside surface of the bifurcation to the opening to provide a pointed end so that engagement of the tapered end with an opening in the mesh causes the bifurcations to more tightly engage yarn disposed therebetween.

2. A tool in accordance with claim 1 wherein the length of the bifurcations is at least five times greater than the spacing between the bifurcations.

3. A tool in accordance with claim 1 wherein each end of the bifurcations is a conic section.

4. A tool in accordance with claim 1 wherein (a) the length of the bifurcations is at least five times greater than the spacing between the bifurcation and (b) each end of the bifurcations is a conic section.

5. A tool in accordance with claim 1 wherein each of the bifurcations has an inside surface which is substantially flat for gripping said yarn, the inside surfaces being joined together to form said vertex.

6. A tool in accordance with claim 2 wherein each of the bifurcations has an inside surface which is substantially flat for gripping said yarn, the inside surfaces being joined together to form said vertex.

7. A tool in accordance with claim 3 wherein each of the bifurcations has an inside surface which is substantially flat for gripping said yarn, the inside surfaces being joined together to form said vertex.

8. A tool in accordance with claim 4 wherein each of the bifurcations has an inside surface which is substantially flat for gripping said yarn, the inside surfaces being joined together to form said vertex.

9. A tool in accordance with claim 1 further comprising a second member joined to the second end of the handle, the second member having a first section extending from said second end parallel to the longitudinal axis and a second section joined to the first section by a 90 degree angle.

10. A tool in accordance with claim 2 further comprising a second member joined to the second end of the handle, the second member having a first section extending from said second end parallel to the longitudinal axis and a second section joined to the first section by a 90 degree angle.

11. A tool in accordance with claim 3 further comprising a second member joined to the second end of the handle, the second member having a first section extending from said second end parallel to the longitudinal axis and a second section joined to the first section by a 90 degree angle.

12. A tool in accordance with claim 4 further comprising a second member joined to the second end of the handle, the second member having a first section extending from said second end parallel to the longitudinal axis and a second section joined to the first section by a 90 degree angle.

13. A tool in accordance with claim 5 further comprising a second member joined to the second end of the handle, the second member having a first section extending from said second end parallel to the longitudinal axis and a second section joined to the first section by a 90 degree angle.

14. A tool for use in grasping yarn during the making of needlepoint with a mesh having openings through which yarn is stitched comprising:

(a) a handle having first and second ends disposed on a longitudinal axis;

(b) a member extending from the first end of the handle along the longitudinal axis; and (c) a yarn grasping means joined to an end of the member at a position remote from the first end of the handle, said yarn grasping means having first and second bifurcations extending in the direction of the longitudinal axis, the bifurcations respectively having first and second ends and being joined together at one end to form a vertex for grasping yarn in the vertex, the bifurcations being spaced apart from each other along the longitudinal axis except in proximity to vertex to form an opening through which yarn can pass for grasping within the vertex, each bifurcation being deflectable to permit deflection toward the other bifurcation when engaging an opening in the mesh to tighten the grasp of yarn disposed between the bifurcations and to spring back to their spaced apart position when not engaging an opening in the mesh, the first and second ends of the bifurcations which define said opening having a taper extending from an outside surface of the bifurcation to the opening to provide a pointed end tapered toward the center of the opening so that engagement of the tapered end with an opening in the mesh causes the bifurcations to more tightly engage yarn disposed therebetween.

15. A process for needlepointing using a tool having a handle having first and second ends disposed on a longitudinal axis; a member extending from the first end of the handle along the longitudinal axis; and a yarn grasping means joined to an end of the member at a position remote from the first end of the handle, said yarn grasping means having first and second bifurcations extending in the direction of the longitudinal axis, the bifurcations respectively having first and second ends and being joined together at one end to form a vertex for grasping yarn in the vertex, the bifurcations being spaced apart from each other by a substantially constant distance along the longitudinal axis except in proximity to the vertex to form an opening through which yarn can pass for grasping within the vertex, each bifurcation being deflectable to permit deflection toward the other bifurcation when engaging an opening in the mesh to tighten the grasp of yarn disposed between the bifurcations and to spring back to their spaced apart position when not engaging an opening in the mesh, the first and second ends of the bifurcations which define said opening having a taper extending from an outside surface of the bifurcation to the opening to provide a pointed end so that engagement of the tapered end with an opening in the mesh causes the bifurcations to more tightly engage yarn disposed therebetween comprising (a) providing a mesh having openings through which yarn is to be stitched; and (b) stitching the yarn through the openings to form a desired pattern with the yarn being grasped in the vertex of the tool while passing through each opening.

16. A process for needlepointing in accordance with claim 15 wherein the bifurcations are deflected inward by contact with the mesh while the yarn is passing through each opening whereby the yarn is securely grasped.

* * * * *